US006016893A

United States Patent [19]

Chen et al.

[11] Patent Number: 6,016,893

[45] Date of Patent: Jan. 25, 2000

[54] MULTI-PURPOSE TRAVELING SUITCASE

[76] Inventors: Rui-Tang Chen, 2nd Floor, No. 29-1, Lane 157, Section 1, Sinsheng South Road, Taipei, Taiwan; Joseph Chen, No. 4 Lantawan street, Quezon City, Philippines

[21] Appl. No.: 08/969,573

[22] Filed: Nov. 13, 1997

Related U.S. Application Data

[63] Continuation-in-part of application No. 08/502,889, Jul. 17, 1995, abandoned.

[51] Int. Cl.[7] ..... A45C 5/14; A45C 9/00; A45C 13/38

[52] U.S. Cl. ..... 190/1; 190/8; 190/15.1; 190/18 A; 280/37

[58] Field of Search ..... 280/37, 43.1; 16/29; 190/1, 8, 18 A, 111, 112

[56] References Cited

U.S. PATENT DOCUMENTS

| | | | |
|---|---|---|---|
| 803,732 | 11/1905 | Turner | 190/111 |
| 1,092,506 | 4/1914 | Oldroyd | 190/18 A X |
| 1,503,714 | 8/1924 | Schnipper et al. | 280/37 |
| 2,170,227 | 8/1939 | Weber | 280/37 |
| 2,334,079 | 11/1943 | Feinberg | 190/111 |
| 2,549,958 | 4/1951 | Bosk | 280/37 |
| 2,552,438 | 5/1951 | Kramer | 190/111 |
| 2,564,266 | 8/1951 | Linton | 280/37 |
| 2,631,699 | 3/1953 | Schultz | 190/8 |
| 2,693,366 | 11/1954 | Randolph | 280/37 |
| 2,778,653 | 1/1957 | Denby et al. | 280/37 |
| 3,352,568 | 11/1967 | Ahlf | 280/37 X |
| 3,413,011 | 11/1968 | Weitzner | 280/37 |
| 3,679,223 | 7/1972 | Sakal | 280/37 |
| 3,797,695 | 3/1974 | Law | 190/8 X |
| 4,118,048 | 10/1978 | Spranger et al. | 190/18 A X |
| 4,575,109 | 3/1986 | Cowdery | 190/18 A X |
| 4,763,911 | 8/1988 | Gebhard et al. | 190/37 |
| 4,771,871 | 9/1988 | Lambracht | 190/18 A X |
| 5,209,328 | 5/1993 | Kotkins, Jr. | 190/18 A |
| 5,230,450 | 7/1993 | Mahavi et al. | 190/8 X |
| 5,374,073 | 12/1994 | Hung-Hsin | 190/18 A X |
| 5,395,154 | 3/1995 | Wang | 280/37 X |
| 5,507,508 | 4/1996 | Liang | 190/18 A X |
| 5,593,008 | 1/1997 | Magnusson | 190/8 |
| 5,769,194 | 6/1998 | Chang | 190/18 A |

FOREIGN PATENT DOCUMENTS

| | | | |
|---|---|---|---|
| 139985 | 1/1951 | Australia | 280/37 |
| 623799 | 6/1927 | France | 190/8 |
| 1340742 | 9/1987 | U.S.S.R. | 190/8 |

*Primary Examiner*—Sue A. Weaver

[57] ABSTRACT

This invention relates to a multi-purpose traveling suitcase which comprises: (1) a backboard; (2) a fixed case attached to the lower front side of the backboard, wherein the fixed case has a pair of casters located at the lower front outer corners away from the backboard; (3) a swinging case attached to the upper side of the backboard, and (4) a scissor-like support at the back side of the backboard, wherein the scissor-like support comprises a pair of leg members and a pair of drive rod members, wherein the pair of leg members comprises a pair of leg wheels at the lower ends. The swinging case can be swung backward, which, with the support of the scissor-like support, turns the multi-purpose traveling suitcase into a stroller. The additional features of the multi-purpose traveling suitcase include, but not limited to: a back case located at the back side of the backboard; a foot rest attached to the lower front side of the fixed case; two foldable side protection boards used as the arm rests for the stroller; a pair of extension rods extended from the upper ends of the pair of drive rod members; and a connector located at the front lower corners of the swinging case to firmly connect the swinging case to the fixed case.

9 Claims, 12 Drawing Sheets

MULTI-PURPOSE TRAVELING SUITCASE

This application is a continuation-in-part of application of JOSEPH CHEN and RUI-TANG CHEN, U.S. Ser. No. 08/502,889 filed Jul. 17, 1995, now abondoned, and entitled a Multi-Purpose Traveling Suitcase.

BACKGROUND OF THE INVENTION

The present invention relates in general to a traveling suitcase. More particularly, it concerns with a multi-purpose traveling suitcase which helps a traveler alleviate the troubles involved in having too many pieces of baggage while traveling, and is an improvement of our U.S. Patent Pending, Ser. No. 08/502,889, filed Jul. 17, 1995 by JOSEPH CHEN and RUI-TANG CHEN.

A traveler is usually inconvenienced and burdened by the numerous suitcases and the like he carries with him. Most especially, when the traveler has a baby, a baby cart or a stroller becomes a necessity, and the situation worsens. To minimize the inconveniences, various innovations, such as a foldable, compact, lightweight stroller to lessen the burden of a mother; an expandable wheeled pull along cart to help move heavier baggage; or a foldable lightweight sitting stool to alleviate the fatigue caused by long time waiting for a ride , etc., are introduced. Helpful and convenient as these are, they also pose considerable problems: when they are not needed, such as when the baby is in the mother's arms, or when the traveler is taking a ride, these aids all at once become burdens themselves. To alleviate the aforementioned inconveniences and burden of a traveler, said U.S. Ser. No. 08/502,889 filed Jul. 17, 1995 provides a multi-purpose traveling suitcase which can be used as a hand carried suitcase, a pulling suitcase on its rear wheels, a wheeled baggage carrier, a baby stroller, and a sitting stool. It is compact, lightweight, rigid and versatile.

However, while said multi-purpose traveling suitcase of our pending application is generally satisfactory in achieving its intended objectives, it is also found to have the following shortcomings, namely:

1. When the scissor-like support of the multi-purpose traveling suitcase of our pending application is extended to form a steerable pushing cart, and the swinging case is swung up to form a chair-like body, the handle bar on the swinging case also elevates to a position and height which is convenient for pushing, pulling, or steering of the cart. But if the swinging case is not swung up such as when the chair-like formation of the body is not needed, the handle bar is at its lowest position and is not accessible to the traveler's hands, resulting in a four wheel suitcase without a pushing or pulling handle.

2. As the multi-purpose traveling suitcase of U.S. Ser. No. 08/502,889 is divided into a fixed case and a swinging case, the length of either cases is only about one-half the length of a standard suitcase, and is inconvenient when the suitcase needs to accommodate longer objects such as a folded shirt, a dress, an umbrella, etc.

It is then an objective of the present invention to provide a multi-purpose traveling suitcase which is compact, rigid, light in weight, convertible and versatile in its use as a carrying suitcase, a pull-along suitcase, a baggage cart, a baby stroller, and a sitting stool.

BRIEF SUMMARY OF THE INVENTION

A specific object is to provide a multi-purpose traveling suitcase which is easy to push and pull on its four wheels either as a suitcase, a baggage carrier or a stroller.

A further object is to provide a multi-purpose traveling suitcase which is versatile in its use as it accommodates both short and long objects for its contents.

Other objects and advantages of the present invention will become apparent upon the reading of the detailed description taken together with the accompanying drawings, wherein:

DETAILED DESCRIPTION OF THE INVENTION

Figure 1:
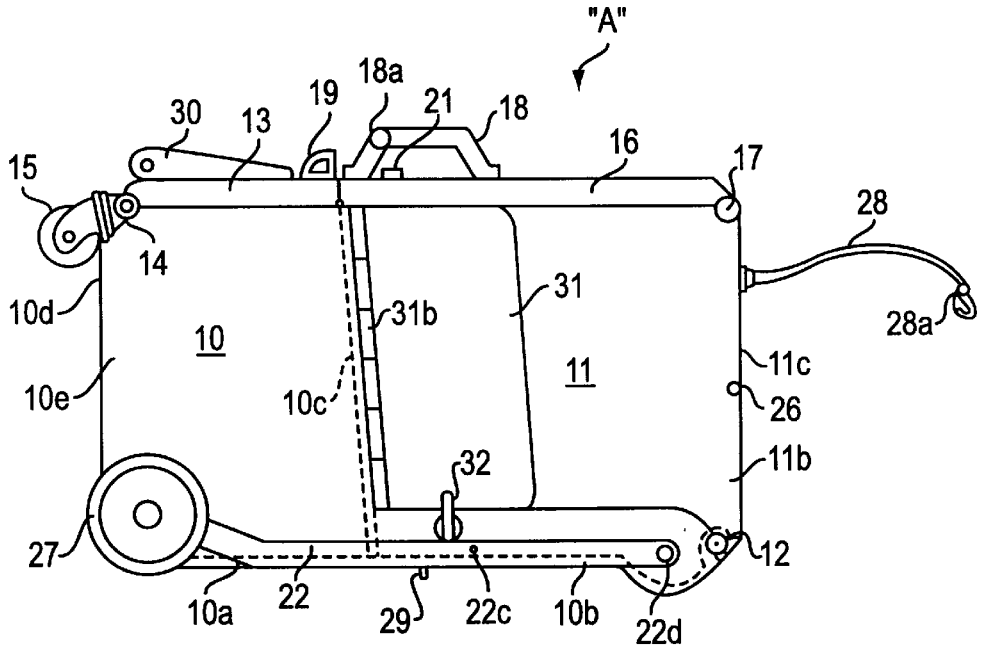
FIG. 1 is a side elevational view of a multi-purpose traveling suitcase when hand carried.
Figure 2:
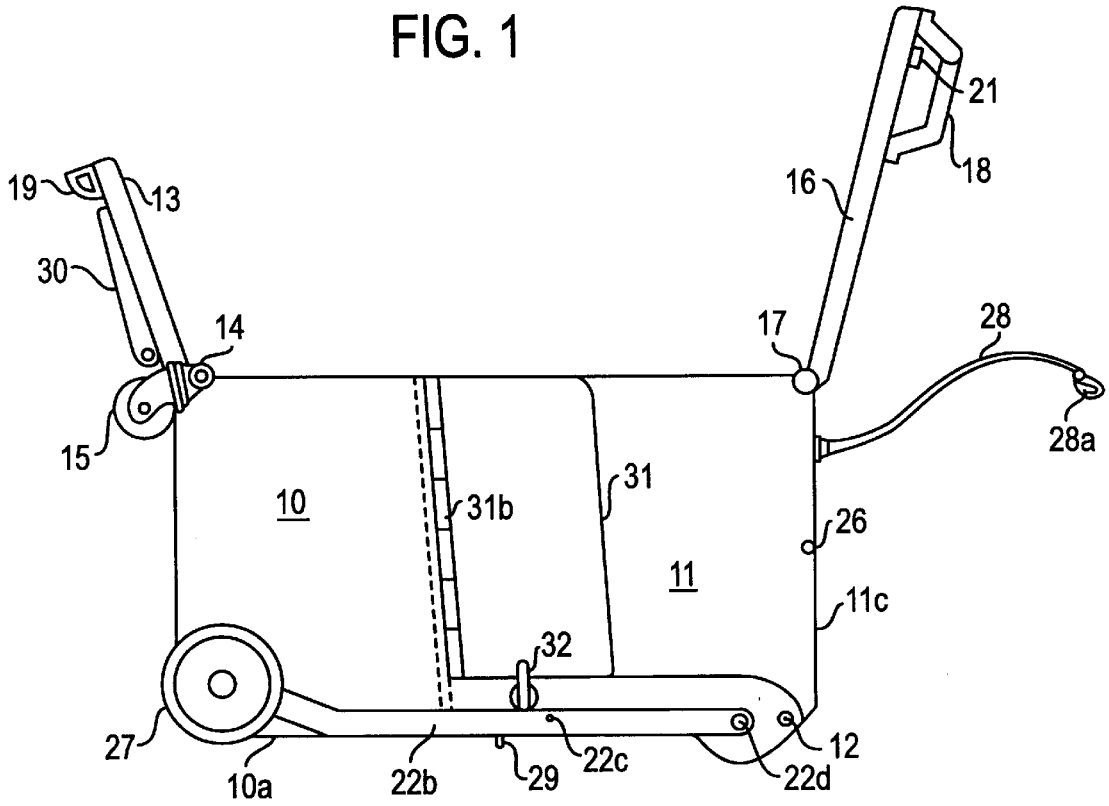
FIG. 2 is a view similar to FIG. 1 showing the associated lids of the fixed case and the swinging case in their open position.
Figure 3:
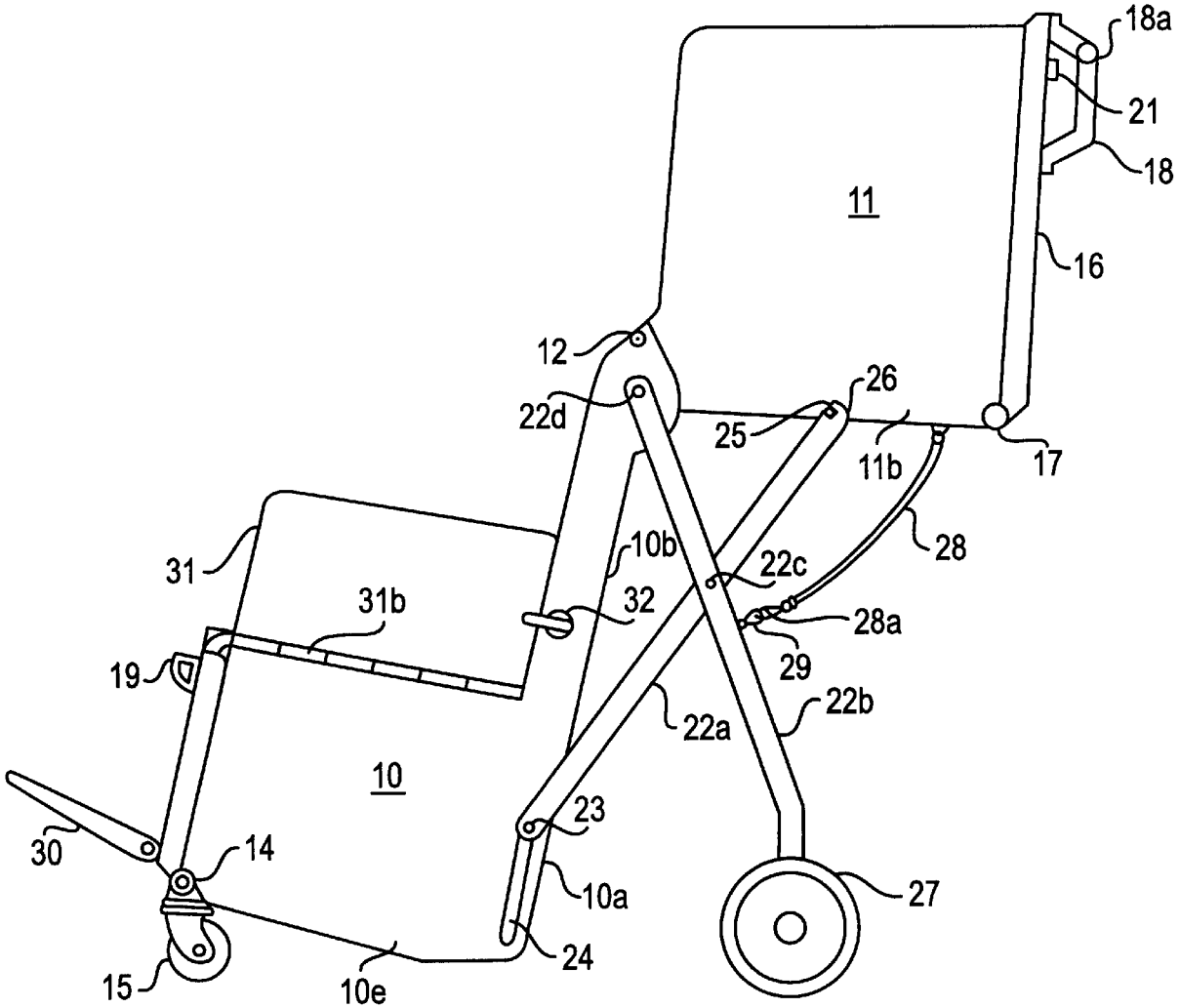
FIG. 3 is a side elevational view illustrating a wheeled baby cart when the swinging case is swung backwards.
Figure 4:
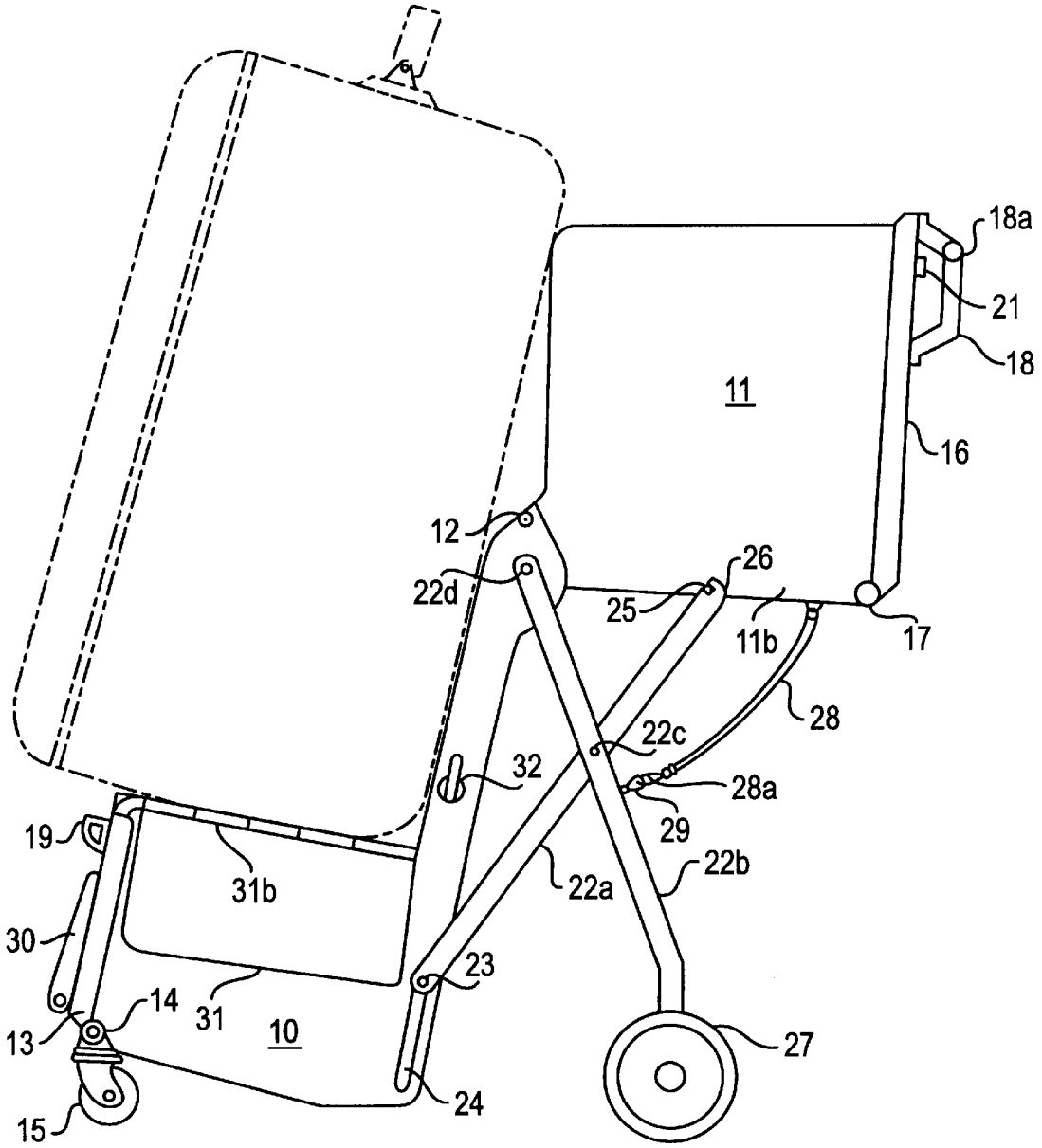
FIG. 4 is a view similar to FIG. 3, illustrating a traveling suitcase when employed as a baggage carrier.
Figure 5:
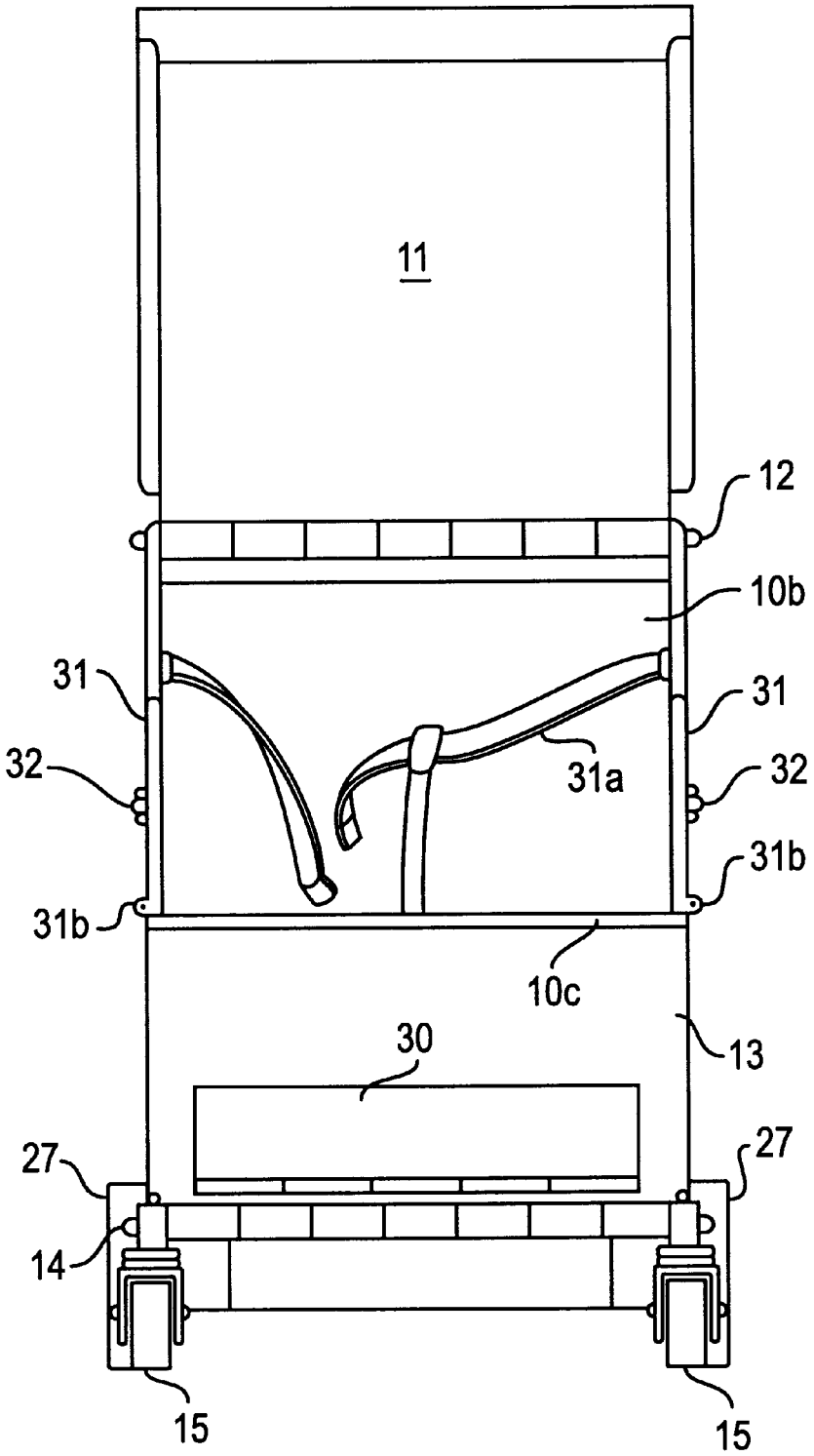
FIG. 5 is a front view of FIG. 3.
Figure 6:
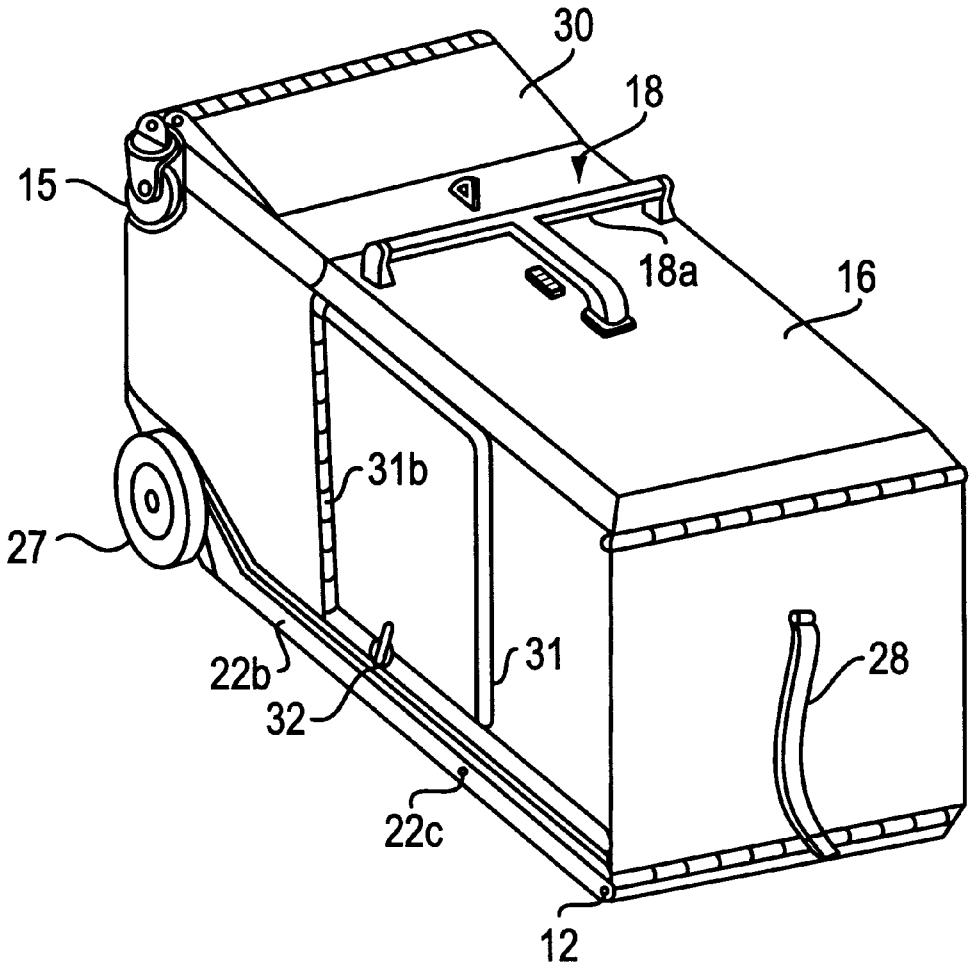
FIG. 6 is a perspective view of FIG. 1 showing the carrying handle in its perspective form.

In our patent pending U.S. Ser. No. 08/502,889 filed Jul. 17, 1995 for A Multi-Purpose Traveling Suitcase, FIGS. 1 to 7, inclusive, detailedly described the invention. The traveling suitcase "A" (FIG. 1) comprises two molded cases, namely; a fixed case 10 with a bottom wall 10*b* having an extended wall 10*b* (FIG. 3), a swinging case 11 disposed in juxtaposed relation with the fixed case 10, and is supported on and hingedly held at the distal end of the extended bottom wall 10*b* by a hinge 12. The fixed case 10 is provided with an associated lid 13 pivotally held by the hinge 14 at the upper edge of the fixed case front wall 10*d* together with two caster wheels 15, both pivot at the upper corners thereof. The swinging case is also provided with an associated lid 16 pivotally held by hinge 17 at the upper edge of the swinging case rear wall 11*c*. A handle 18 and two-way lock 21 are provided on the distal end of the swinging case lid 16, and a twist lock 19 is also provided on the fixed case lid 13. A pair of identical scissor-like leg supports 22 are provided at the lower part of the right and left walls 10*e* of the fixed case 10 (FIGS. 3 and 4). Each of the identical leg supports consists of a first leg member 22*a* and a second leg member 22*b* pivotally held together by a pivot pin 22*c*. (For brevity, only one leg support 22 is herein described.) The front end of the first leg member 22*a* is slidably held by a pin 23 sliding along an elongated slot 24 provided at the lower part of the right and left walls 10*e* of the fixed case and the distal end is provided with a U-shaped opening 25 adapted to support a rest pin 26 secured at the lower edge of the swinging case side walls 11*b*. The front end of the second leg member 22*b* is provided with a leg wheel 27, and the distal end is hingedly connected on the hinge 22*d*. On the right and left sides of the bottom wall 10*b* are formed with recessed portions (not shown) adapted to receive the leg member in flush relation with surface of the fixed case side walls when in folded position. Thus, only the leg wheels 27 protrude on the sides (FIG. 5). A pair of side protection boards 31 are connected to the upper edges of the right and left side walls 10*e* of the fixed case by a pair of piano hinges 31*b* and are locked in place by a twist lock 32 provided on the extended bottom wall 10*b*. A baby's protection strap 31*a* is secured at the bottom wall 10*b*. As shown in FIGS. 1 and 2, a pulling strap 28 is attached to the swinging case 11. This pulling strap contains a spring hook lock 28*a* at the distal end of the pulling strap. The spring hook lock 28*a* engages and locks onto a ring 29 located on the second leg member 22*b* to ensure secure holding of the swinging case. A foldable foot rest 30 is hingedly held on the fixed case lid 13.

The traveling suitcase "A" when in its folded and hand carried form, provide two separate compartments, namely: fixed case 10 and swinging case 11. In this formation, different kinds of commodities, such as thermos bottles, milk bottles, food, medicines, etc., are stored in one compartment while baby dresses, diapers and the like can be stored in another to avoid soiling. The twist lock 19 on associated lid 13 and the two two-way locks 21 on both associated lid 13 and associated lid 16 provide easy access to and storage of the contents of both the fixed case 10 and the swinging case 11. The two-way lock 21 which affixed to the associated lid 16, when pushed in one way, unlock associate lid 16 from swinging case 11, while pushed in another way, releases the whole swinging case 11 from its juxtaposed relation with the fixed case 10 and allows the swinging case 11 to freely swing upward and backwardly on hinge 12. When traveling suitcase "A" in its folded form, as shown in FIG. 1, is stood on the ground with its front side wall 10*d* at the bottom, the caster wheels 15 are turned down about 90 degrees, locked in position, and, together with leg wheels 27, support the traveling suitcase "A" and make it mobile.

In this position, unlock the two-way lock 21 to release the swinging case 11 and swing it backward, and at the same time stretch open the scissor-like leg supports 22, so the swinging case 11 with its rest pin 26 engages the U-shape opening 25 of the first leg member 22*a*, and be supported by leg support 22. In this formation, the rear wall 10*c* becomes the top board of the fixed case 10. As the space above the rear wall 10*c* is void, (the swinging case 11 has been swung away), the rear wall 10*c* becomes a level seat board of a chair, and the inclined extended bottom wall 10*b* becomes a back rest. With two side protection boards 31 confining the seat area, like two arm rests, the traveling suitcase "A" becomes a baby cart strolling on 2 caster wheels 15 and two leg wheels 27, as shown in FIG. 3.

In this formation, the foot rest 30 is lowered to its open position to form a foot rest for the baby, and the level transverse part 18*a* of handle 18 on associate lid 16 becomes a push bar for pushing and steering the baby cart. Strap 31*a*, anchored on the bottom wall 10*a*, ensures secure holding of the baby. The pulling strap 28, with its spring hook lock 28*a* engages and locks on ring 29 on second leg members 22*b*, ensures the rigid formation of the component members of the baby cart, and prevent the collapse of swinging case 11 when pushed forward at handle 18. The contents of both the fixed case 10 and the swinging case 11 are still accessible by opening the associate lid 13, and associate lid 16, respectively.

Twist the twist lock 32 to release the side protection board 31, and side protection boards swing downwards to their "fold" position by a pair of hinges 31*b*, thus leave the space above the rear wall 10*c* open, whereon a larger traveling suitcase, or other heavy baggage can be placed and be wheeled away. Thus, the suitcase can be used as a baggage carrier, as shown in FIG. 4.

Actuate the foot brakes (not shown) on leg wheels 27 to render the baggage carrier immobile, and the rear wall 10*c* can serve as a seat board for an adult, thus the traveling suitcase can be utilized as a stool for resting.

When a compact, folded traveling suitcase is again desired, the spring hook lock 28*a* is unlocked to allow the swinging case 11 to be swung forward and be locked to its original folded position. The scissor-like leg supports 22 are folded, the foot rest 30 is pushed back, and the traveling suitcase "A" is again ready to be hand carried, or to be pulled away, as an ordinary compact traveling suitcase, as shown in FIG. 1.

The versatile utilization of the multi-purpose traveling suitcase in effect lessens the number of baggage a traveler, especially one with a baby, has to carry along, and makes a trip easier and safer.

Figure 7:
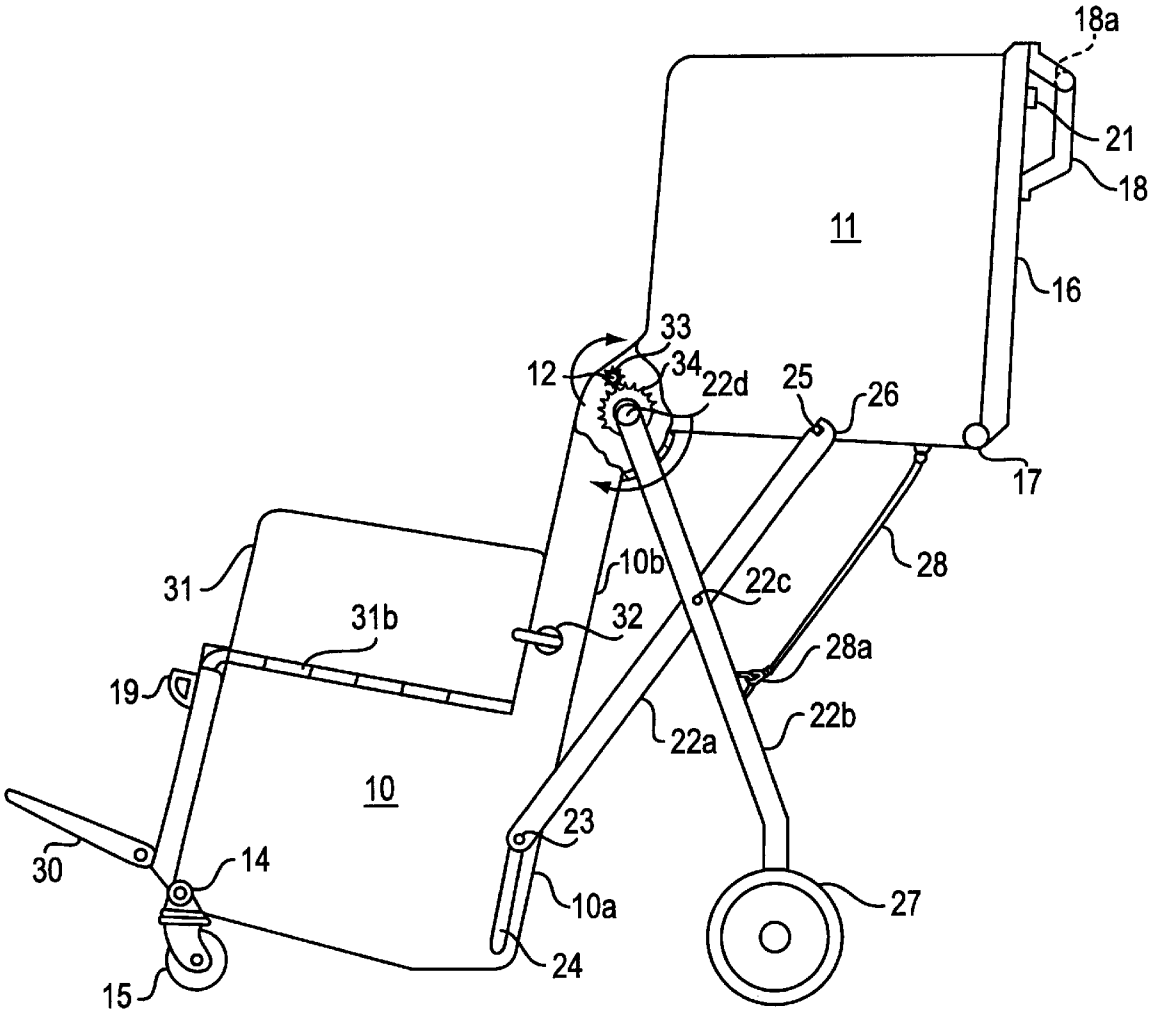
FIG. 7 is a side view similar to FIG. 3 illustrating an embodiment to automatically control the opening and closing of the scissor-like leg supports.

An embodiment to positively control the opening and closing of the identical pair of scissor-like leg supports 22 is illustrated in FIG. 7. As disclosed earlier, when the traveling suitcase is used as a baby cart or as a baggage carrier, the swinging case 11 is swung up and back and the leg members have to be manually opened. In the embodiment shown in FIG. 7, the first and second leg members 22*a* and 22*b*, respectively, opens automatically by means of a driving mechanism provided by meshing driving gears 33 and driven gears 34. When the swinging case is swung upward and backwardly as shown in FIG. 7, two small driving gears 33, which are fixed on the side of the side walls 11*b* of swinging case 11, and are concentric with hinge 12, drive two large driven gears 34 affixed the upper end of the second leg member 22*b* and are in mesh with the driving gears 33. The direction of gear rotations, as shown in FIG. 7 are indicated by arrows when the swinging case 11 is swung up upward and, in this case, the leg supports 22 open up. When the swinging case 11 is swung forward and downwardly, the leg member, moving reversely, automatically move back and close up to their normal folded position.

The improved Multi-Purpose Traveling Suitcase of the present invention is detailedly described based on FIGS. 8–13, inclusive, of the drawings.

Briefly stated, the improved traveling suitcase includes a backboard having on the lower end of its front side a fixed case and on its upper end of the same side a swinging case hingedly held at the upper terminal of said backboard. Each case has an open front provided with an associated hingedly connected cover.

The traveling suitcase when in its folded position is adapted to be hand carried, or to stand on a pair of casters at the front corners of the fixed case as well as leg wheels on the lower ends of a pair of leg members. The upper ends of said leg members are hingedly connected to the mid-portion of the left and right edges of the backboard on its rear side and pivotally swing in, in its "fold" position, to form a hand carried suitcase, or out, to form, together with said casters, a mobile support for the traveling suitcase. In this position, the swinging case can be swung up around the swinging case hinges to form a chair-like cart, and the multi-purpose traveling suitcase can be used as a baby stroller, a baggage carrier, or when brakes on the leg wheels are applied, a sitting stool for resting. A pair of drive rod members, with their lower ends hingedly connected to the lower portion of the left and right edges of the backboard on its rear side slidably engage the leg members at their midportions to form a scissor-like framework for the support of the traveling suitcase. Extension rods united by a handle bar can be pulled out and extended from said drive members to a convenient length and height for pulling, pushing or steering of the traveling suitcase.

A back case is formed on the back side along the length of the backboard to accommodate long articles for contents.

Figure 8:
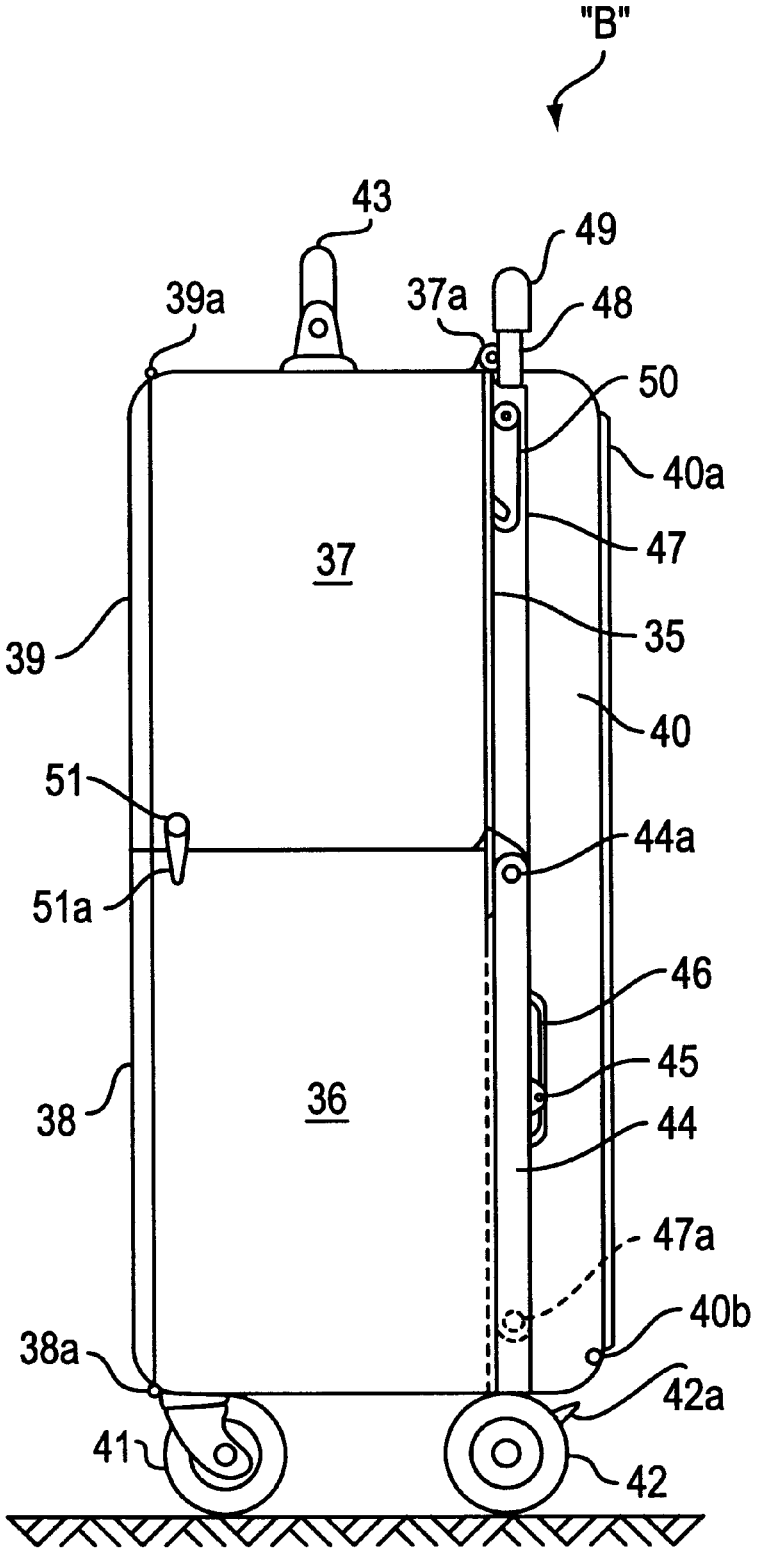
FIG. 8 is a side elevational view of the multi-purpose traveling suitcase when standing on its wheels or in its hand carried position.
Figure 9:
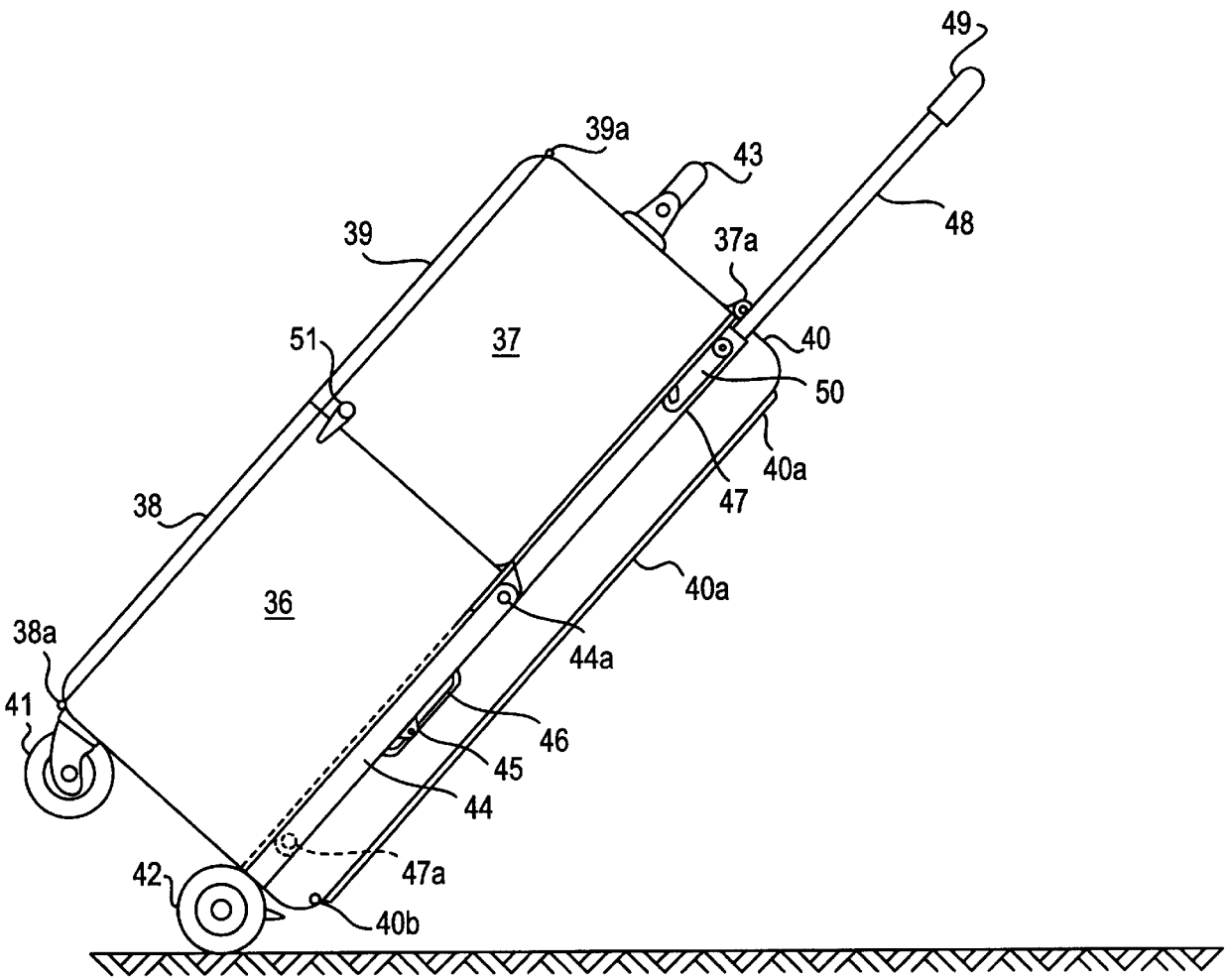
FIG. 9 is a side view similar to FIG. 8 showing its extension rods being pulled out and extended to form a wheeled pull along suitcase.

Connectors are provided on the front lower corners of the swinging case to firmly connect the swinging case to the fixed case. When said connectors are in disconnect position, the swinging case can either be swung up, or, with a detachable swinging case hinge assembly detached, be lifted away and separated from the suitcase main body to be used as a small suitcase, a handbag, or a vanity case. Referring now to the drawings in detail, there is shown in FIG. 8 a multi-purpose traveling suitcase indicated in its entirety as "B".

The improved traveling suitcase B comprises a backboard 35 having the lower end of its front side an integrated fixed case 36 with an open front and on the upper end a swinging case 37 with a similar open front pivotally held at the upper end of the backboard 35 by swinging case hinge 37*a*. The fixed case 36 is provided with an associated fixed case cover 38 pivotally held by a fixed case cover hinge 38*a*. The swinging case 37 is also provided with an associated swinging case cover 39 pivotally held by swinging case cover hinge 39*a*.

A back case 40 with an open rear side is integrally formed on the center portion of the entire length of the backboard 35 and is also provided with an associated back case cover 40*a* pivotally held by a back case hinge 40*b*.

Swiveling casters 41 are provided at both outer corners of fixed case 36 and, together with leg wheels 42, support traveling suitcase B to stand on a level surface in an upright position. Carrying handle 43 is fitted at the top of swinging case 37 for lifting the suitcase off the ground and hand carry it also in this position.

Figure 10:
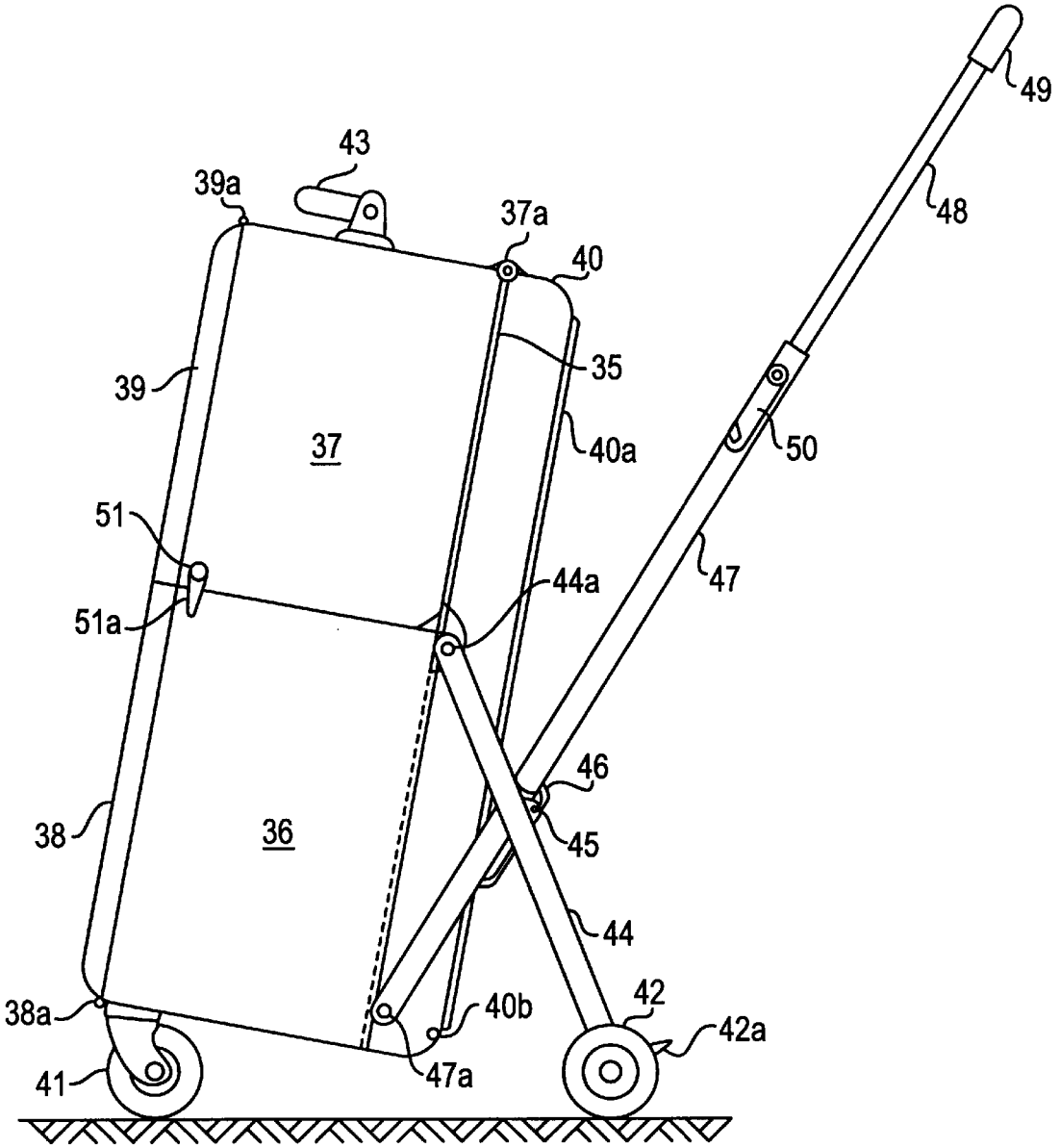
FIG. 10 is a side view of the multi-purpose traveling suitcase showing the scissor-like support members being unfolded and extended and the extension rods pulled out to form a push type wheeled suitcase.
Figure 12:
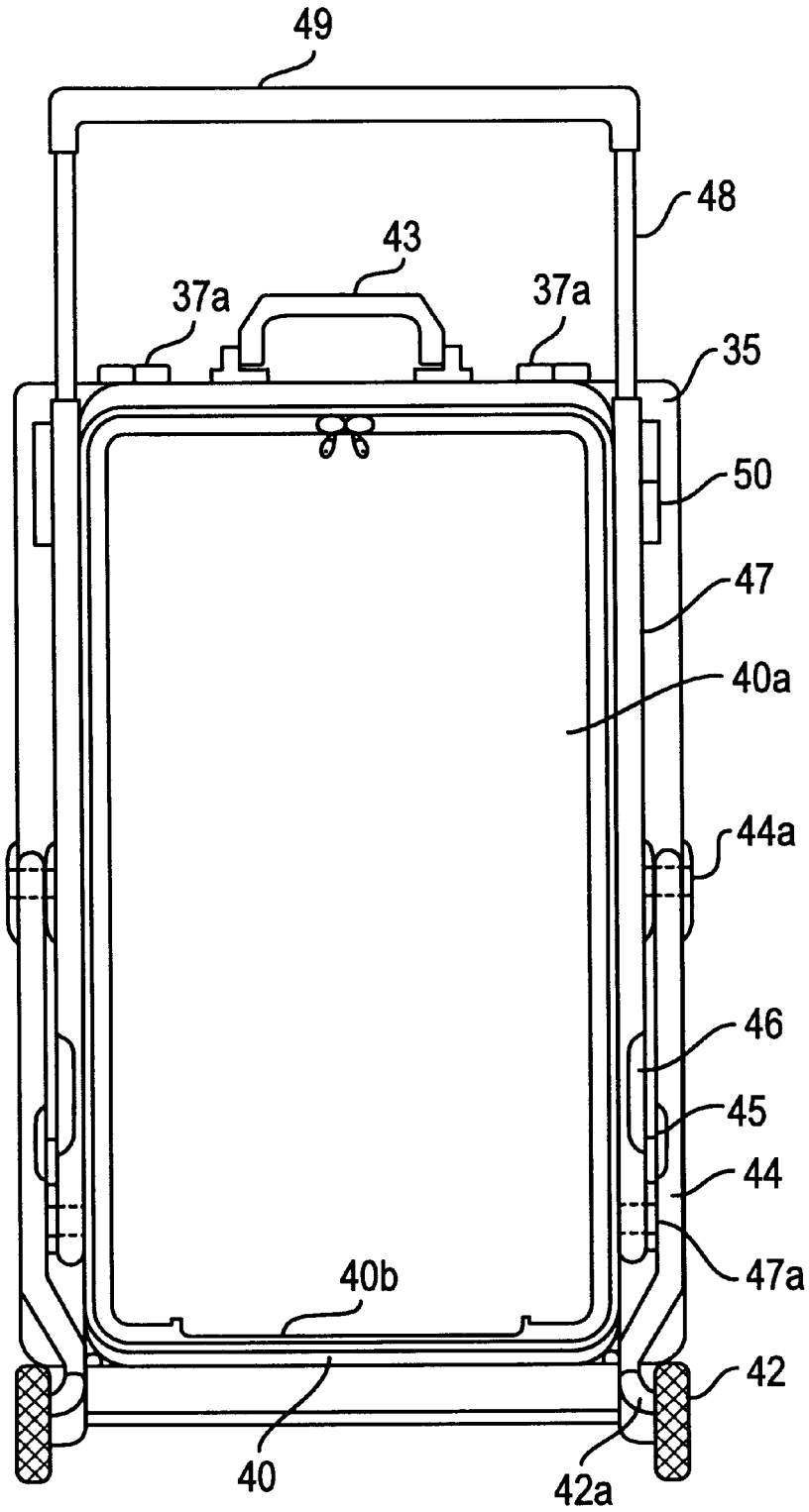
FIG. 12 is a rear view of the multi-purpose suitcase showing the multi-purpose suitcase standing on its two leg wheels, its extension rods with their handle bar partially drawn out, and its back case covered by a zipped cover.

As shown in FIGS. 8, 10 and 12, said leg wheels 42 with associated leg wheel brakes 42*a* are fitted at the lower ends of a pair of leg members 44. The upper ends of leg members 44 are pivotally hinged at the leg hinges 44*a* provided at the mid portion of the back side of the backboard 35 on its left and right edges. Scissor pins 45 on said leg members 44 insert into and slidably engage scissor grooves 46 provided on a pair of driving rod members 47 which are positioned between back case cover 40*a* and leg members 44 (FIG. 12) in their folded form, and their lower ends are pivotally hinged to the driving rod hinge 47*a* on the lower left and right edges of the back side of backboard 35. The hollow body of said driving rod members 47 telescopically receive a pair of extension rods 48 which are united by a handle bar 49 and can be contracted into or extended from said driving rod member 47. Said extension rods 48, when extended, the handle bar 49 reaches a maximum length and height for convenient, easy pulling, pushing or steering of the multi-purpose traveling suitcase "B".

Figure 11:
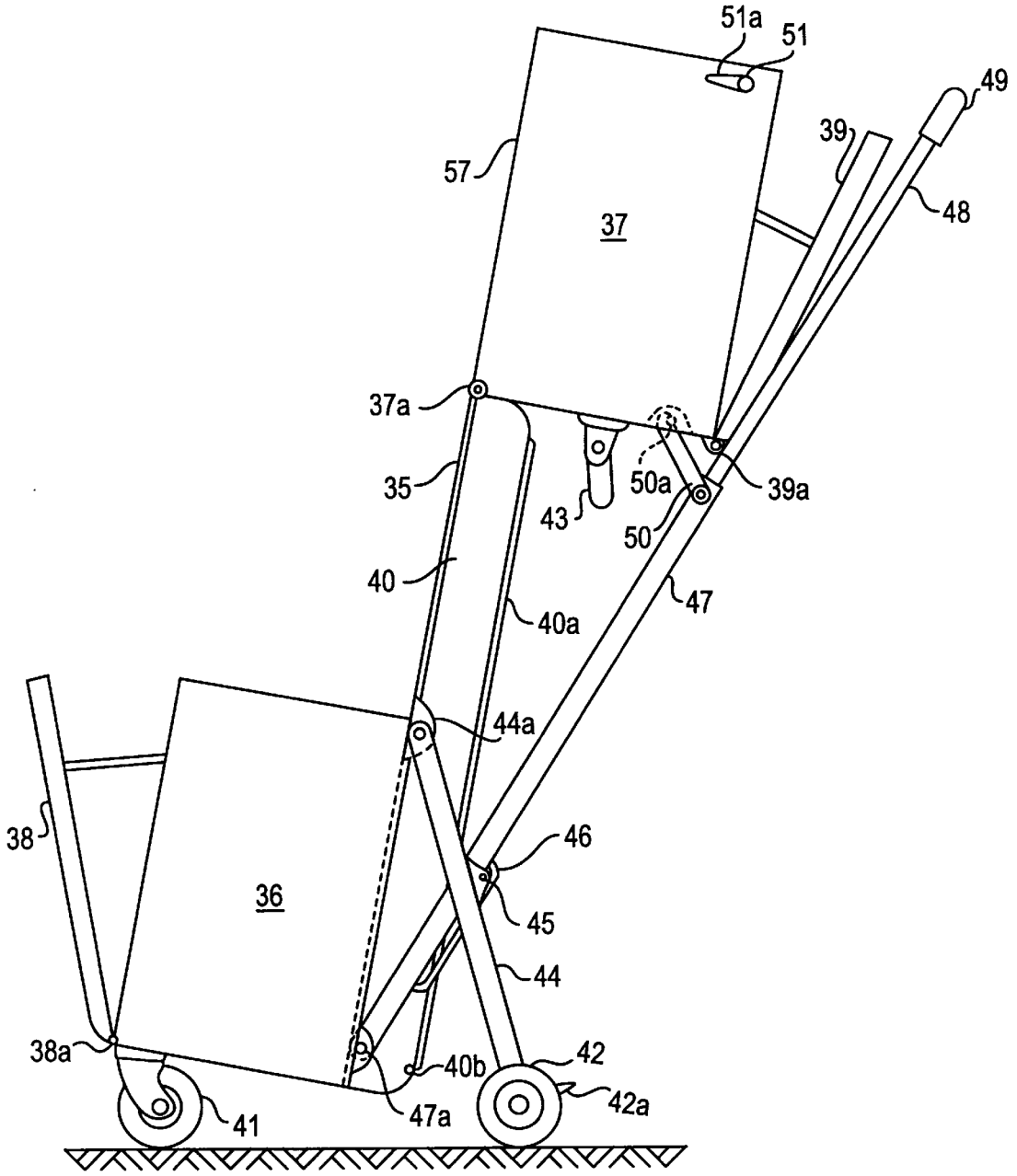
FIG. 11 is a side view of the multi-purpose traveling suitcase similar to FIG. 10 showing its swinging case being swung up to form a chair-like cart or carrier for use as a baggage carrier, a baby stroller, or a sitting stool, and its associated covers of the fixed case and the swinging case in their partially open position for access to the contents.

When driving rod members 47 are pivotally swung backward on driving rod hinges 47*a*, as shown in FIG. 10, the sweeping action of scissor grooves 46 force scissor pin 45, while sliding along scissor grooves 46, also to move backward, causes leg members 44, together with leg wheels 42 to swing backward. Driving rod members 47 and leg members 44, thus, engage in a scissor-like action until scissor pins 45 reaches the upper ends of scissor grooves 46 and stop. In this position, with the traveling suitcase inclines backwards, and the distance between casters 41 and leg wheels 42 widened, the multi-purpose traveling suitcase "B" is mobile, stable and steerable, and also is rigid enough for carrying heavy loads. Also in this position, if extension rods 48 are drawn up, and swinging case 37 is pivotally swung upward around swinging case hinges 37*a* as shown in FIG. 11, the hook bar 50 hingedly connected on the driving rod members 47 is hooked on a bar pin 50*a* secured at the bottom of the swinging case 37 (FIG. 11) near the rear corner thereof to prevent swinging case 37 from swinging back down, then the space vacated above fixed case 36 can serve as a seat of a baby stroller, the platform of a baggage carrier, or, when leg wheel brakes 42*a* are applied, a sitting stool. Backboard 35 together with side wall 57 on the swinging case 37 can serve as the backrest of the seat, or the leaning wall of a baggage. As again shown in FIG. 11, fixed case cover 38 and swinging case cover 39 are partially opened for access to their contents when the multi-purpose traveling suitcase is being used as a baby stroller or as a sitting stool. In FIG. 12, back case 40 is shown to have its back case cover 40*a* zipped, and the length of the case is almost equal to the total length of the suitcase body, and thus is capable of accommodating long articles such as a folded shirt, a dress, or an umbrella. The four walls of said case 40 also contributes to the rigidity of backboard 35 for withstanding heavier loads.

Figure 13:
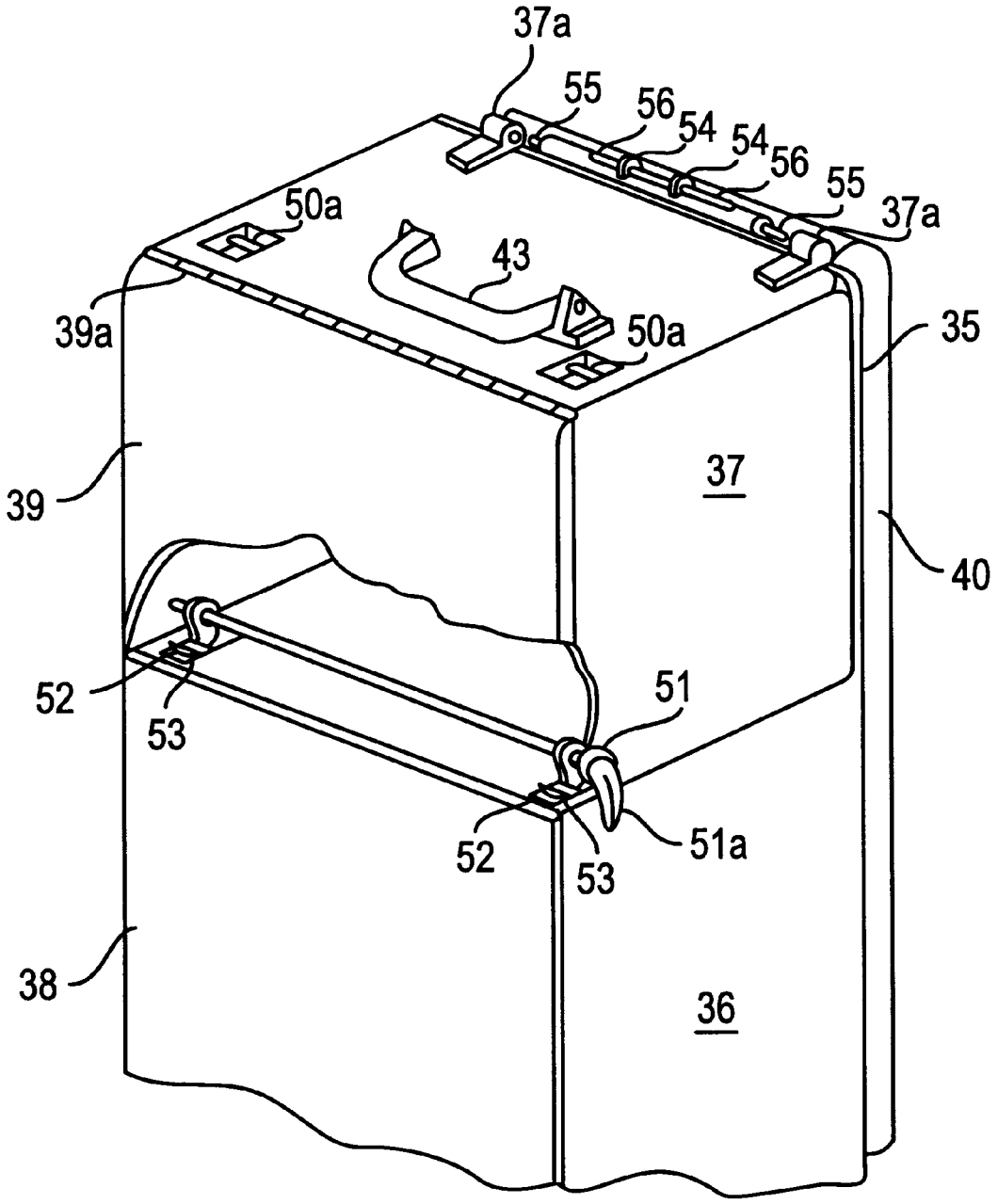
FIG. 13 is a perspective partial view of the fixed case, the swinging case, and the backboard of the multi-purpose traveling suitcase showing the swinging case hinges on the swinging case ready to be engaged by a detachable hinge assembly on the backboard and the connectors on the outer corners of the swinging case engage the swinging case to the fixed case.

Connector 51 having a connector lever 51*a* and connector hook 52 is provided on the outer edge of swinging case 37 adjacent to case 36 and, when actuated by connector lever 51*a*, said connector hook 52 extends from swinging case 37 into fixed case 36 through an opening to engage connector pin 53 on fixed case 36 in a firm connection, thus also firmly connect swinging case 37 to fixed case 36. Since swinging case 37 is also connected by swinging case hinge 37*a* to the terminal end of backboard 35, and since backboard 35 is an integrated part of fixed case 36, swinging case 37 is therefore firmly connected to the rest of the suitcase body, and the multi-purpose traveling suitcase "B", at its folded position such as shown in FIG. 8 can be lifted and hand carried by holding the carrying handle 43. If connector handle 51*a* is used to actuate connector hook 52 to disengage itself from connector pin 53 on fixed case 36, swinging case 37 will be free to swing up and pivot on swinging case hinge 37*a*. In this case, if a pair of hinge pin pullers 54 (FIG. 13) are pinched towards each other to compress the spring between them (not shown in the drawings), as shown in FIG. 13, hinge pins 55 will retract along hinge pin guides 56 and extricate themselves from the trapping holes on swinging case hinge 37*a*, thus freeing the swinging case 37 from backboard 35. Now as swinging case 37 is free from the rest of the traveling suitcase, it can be lifted, carried away, and be used independently as a small traveling suitcase, a handbag, or a vanity bag.

Return the detached swinging case 37 back to the void space above fixed case 36, pinch the hinge pin pullers 54 to pull inwardly the hinge pins 55, position and align swinging case hinge 37*a* on the upper end of backboard 35, release hinge pin pullers 54 to let the spring between them push two hinge pins 55 outwardly to insert into the holes on swinging case hinge 37*a* to hingedly connect swinging case 37 to backboard 35, then, with connectors 51 firmly connect swinging case 37 to the fixed case 36, multi-purpose traveling suitcase "B" can be lifted and hand carried, or, with extension rods 48 drawn, be pulled along on leg wheels 42. Or, actuate connectors to disconnect swinging case 37 and fixed case 36 on their outer edges, swinging case 37 can be swung back, and multi-purpose traveling suitcase "B" can be used as a baby stroller, a baggage carrier, or a sitting stool.

We claim:

1. A multi-purpose traveling suitcase comprising:

a backboard having on the lower end of its front side an integrated fixed case with an open front side and on the upper end of its front side a swinging case with an open front side being disposed in a juxtaposed relation with the fixed case and hinge means for hingedly holding the swinging case at the upper end of the backboard, and on a back side of the backboard a back case with an open rear side forming an integrated part of the entire length of the backboard;

associated covers with hinges for connecting to and covering the open sides of said fixed case, swinging case, and back case;

casters provided at lower outer corners of the fixed case farthest away from the backboard;

scissor-like support formed by a pair of leg members and a pair of tubular drive rod members, the upper ends of said leg members including hinge means for hingedly holding the leg members on the midportion of the back side of said backboard on its left and right edges and their lower ends being provided with leg wheels with brakes, the lower ends of said tubular drive rod members including hinge means for hingedly holding the tubular drive rod members on a lower portion of the back side of the backboard and on its left and right edges and their upper ends telescopically receive a pair of extension rods united by a handle bar;

scissor grooves and scissor pins slidably engage the tubular drive rod members to the leg members for a folded or extended formation of the scissor-like support whereby the suitcase may be transported by rolling on the casters and leg wheels;

connectors with connector levers on lower outer corners of the swinging case for a locking engagement of the swinging case with aligned connecting means on outer upper corners of the fixed case or disengagement of said swinging case from the fixed case whereby the swinging case may be swung on its hinge means away from the fixed case to permit the suitcase to be used as a stroller.

2. The multi-purpose traveling suitcase according to claim 1, wherein the hinge means at the upper end of the backboard includes a detachable hinge assembly for hinged locking engagement of said swinging case to or disengagement of the same from said backboard.

3. A multi-purpose traveling suitcase comprising:

a backboard having a front side and a back side, said front side having a lower end and an upper end;

a fixed case integrated at said lower end of said backboard, said fixed case having a pair of casters at lower front outer corners away from the backboard; and a swinging case connecting to said upper end of said backboard by hinge means, wherein said swinging case can be swung backward to permit said suitcase to be used as a stroller;

wherein said suitcase further comprising a pair of leg members and a pair of driving rod members, wherein said pair of leg members has upper ends and lower ends, wherein said upper ends of said pair of leg members are attached to a midportion of said back side of said backboard by hinge means and said lower ends of said pair of leg members are attached to a pair of leg wheels;

wherein said pair of driving rod members comprises lower ends attached to left and right edges of said back side of backboard;

wherein said pair of driving rod members comprises a pair of scissor groove and said pair of leg members comprises a pair of scissor pin, whereby said pair of scissor pins is slidably engaged with said pair of scissor groove to connect said pair of driving rod members with said pair of leg members.

4. The multi-purpose traveling suitcase according to claim 3, wherein said pair of driving rod members further having upper ends to receive a pair of extension rods.

5. The multi-purpose traveling suitcase according to claim 4, wherein said pair of extension rods is united by a handle bar.

6. The multi-purpose traveling suitcase according to claim 3, further comprising a back case at said back side of said backboard.

7. The multi-purpose traveling suitcase according to claim 3, wherein each said leg wheel of said leg member further comprises a wheel brake.

8. The multi-purpose traveling suitcase according to claim 3, further comprising a carrying handle on top of said swinging case.

9. The multi-purpose traveling suitcase according to claim 3, further comprising a connector at front lower corners of said swinging case to firmly connect said swinging case to said fixed case.

* * * * *